United States Patent [19]

Hiestand et al.

[11] Patent Number: 4,498,512

[45] Date of Patent: Feb. 12, 1985

[54] LUMBER SAW-SIZING TOOL

[76] Inventors: Wilfred Hiestand, 8806 Birchleaf Ave., Downey, Calif. 90240; Everett O. Oliver, 15504 E. Hornell, Whittier, Calif. 90604

[21] Appl. No.: 404,446

[22] Filed: Aug. 2, 1982

[51] Int. Cl.[3] ..... B27C 9/00

[52] U.S. Cl. ..... 144/2 R; 15/236 C; 29/78; 30/347; 144/2 D; 144/118

[58] Field of Search ..... 30/276, 347; 15/236 R, 15/236 C; 29/81, 78; 144/2 R, 2 D, 115, 118, 114 R, 361, 362, 1 F

[56] References Cited

U.S. PATENT DOCUMENTS 3,216,041 11/1965 Walters ..... 144/118 X
3,754,297 8/1973 Metz ..... 114/118
3,852,843 10/1974 Metz ..... 114/118
4,069,568 1/1978 Sakamoto et al. ..... 29/78

*Primary Examiner*—W. D. Bray
*Attorney, Agent, or Firm*—Robert E. Strauss

[57] ABSTRACT

The invention comprises an attachment for a portable hand-tool for the dressing of lumber to obtain roughened or saw-sized surfaces. The attachment comprises a circular disk having a hub to attach it to a portable rotary drive such as a rotary hand-grinder, and a rim on the side of the disk opposite the hub. The rim has a recessed groove to receive a portion of a band saw blade at a depth exposing only the gullet and teeth of the blade. The groove is spaced approximately ¼ inch from the outer edge of the rim. The tool is used by making multiple passes across the surface to be roughened or saw-sized, permitting on-site saw-sizing of lumber.

6 Claims, 4 Drawing Figures

FIG. 1
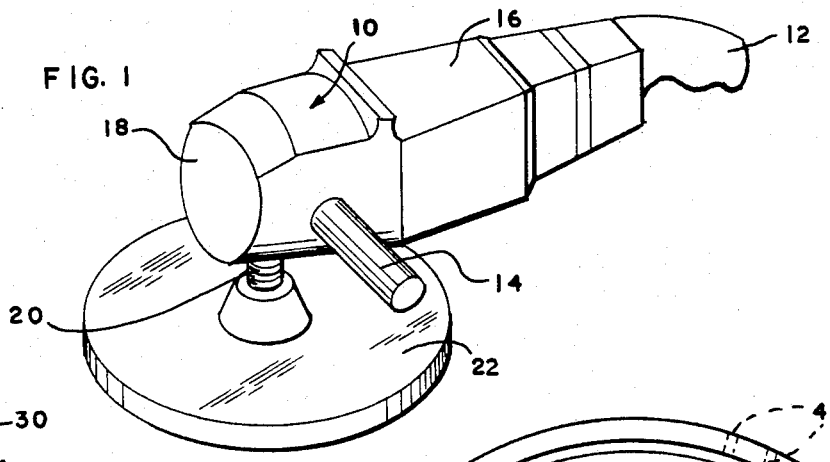
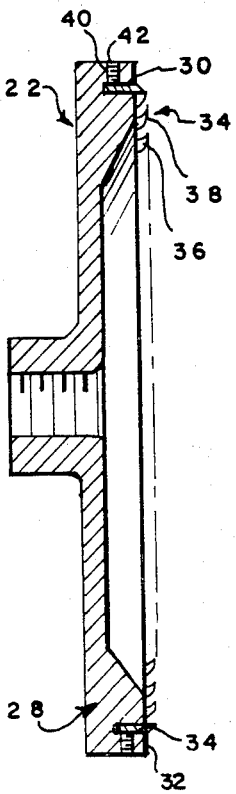
FIG. 2
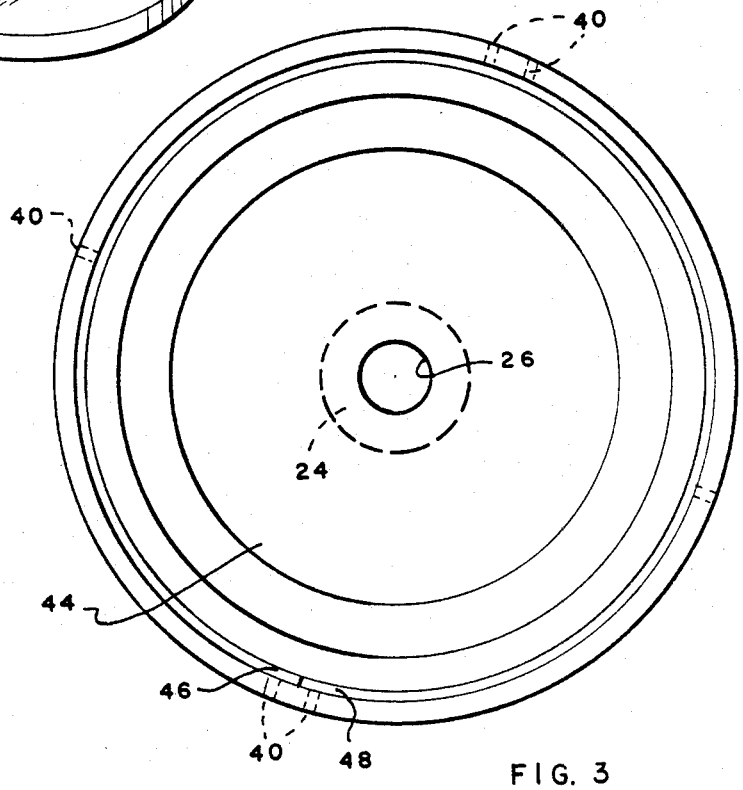
FIG. 3
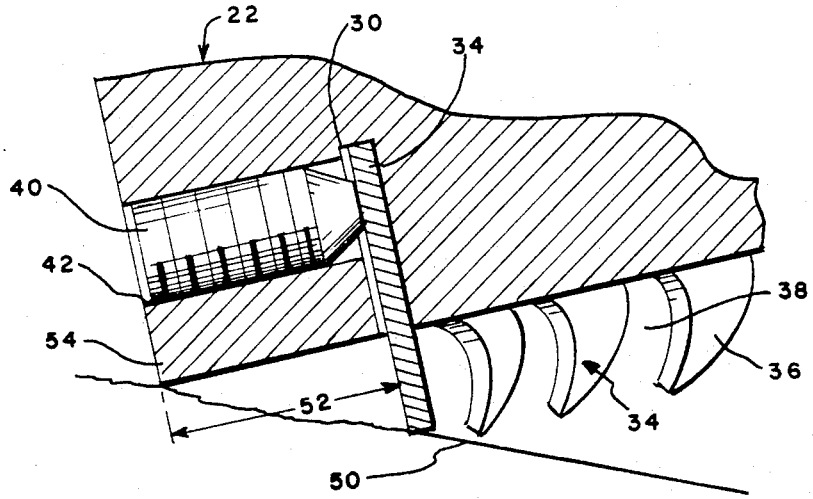
FIG. 4

LUMBER SAW-SIZING TOOL

BACKGROUND OF THE INVENTION

1. Field of the Invention

This invention relates to dressing of lumber and, in particular, relates to an attachment for a hand-tool to permit on-site dressing of lumber to saw-sized surfaces.

2. Brief Statement of the Prior Art

Lumber used in commercial and residential construction is commonly available in the S4S designation, meaning surfaced on four sides. This lumber is smoothly dressed. In many applications a rustic appearance is desired and saw-sized lumber is required. Saw-sized or surface roughened lumber is usually available only on special order and delays of a few weeks to several months are not uncommon to obtain this grade of lumber. In some cases, lumber which has been dressed to a smooth finish is returned to a mill for saw-sizing to the roughened texture. This practice not only delays construction but, is unduly expensive because of the repetitious handling of the lumber. Furthermore, it is frequently desired to provide a roughened surface on only a portion of lumber, for e.g., only exposed lengths of beams or rafters need a roughened surface appearance.

Some attempts have been made to provide on-site surface roughening of lumber. These attempts have included use of a cement chipper, a hand-tool having a reciprocating chisel blade. These attempts have not provided a satisfactory surface condition. Other attempts have used portions of sabre saw blades, however these attempts have been unsatisfactory because of the difficulty and hazards of this technique.

BRIEF DESCRIPTION OF THE INVENTION

This invention comprises an attachment for a hand-tool such as a rotary grinder to permit the tool to be used for dressing of lumber to saw-size specification and appearance. The attachment comprises a generally circular disk having a hub with attachment means permitting its removable attachment to a rotary drive such as a rotary hand-grinder, and a peripheral rim having means for the attachment of a portion of a band saw blade to expose only the teeth of the blade. The peripheral rim is supported by a web which extends between the hub and peripheral rim. Preferably, the band saw blade attachment means comprises a groove approximately the thickness of the band saw blade recessed in the working face of a circular plate and having a depth sufficient to permit embedding the blade at a depth which exposes only the teeth of the blade. Preferably, the groove recessed into the surface of the disk is inset approximately $\frac{1}{4}$ inch from the edge of the disk.

BRIEF DESCRIPTION OF THE DRAWINGS

The invention will be described with reference to the figures of which:

FIG. 1 illustrates the attachment operatively secured to a rotary hand-grinder;

FIG. 2 is a side view of the attachment;

FIG. 3 is a plan view of the undersurface of the attachment; and

FIG. 4 is a view of the position of the cutting edge of the tool in use.

DESCRIPTION OF THE PREFERRED EMBODIMENT

Referring now to FIG. 1, the invention is seen in its operative connection to a suitable drive unit. The drive unit illustrated comprises a rotary hand-grinder 10 which has a conventional design including handles 12 and 14 with an electrical drive unit generally indicated at 16 and a right angle gear assembly 18. The output shaft 20 of the rotary drive unit 10 is connected to the lumber dressing tool 22 of the invention.

Suitable rotary drive units are hand grinders which can be pneumatically or electrically powered. Preferably electrical drive units are employed. Typically, the drive units have a constant speed from approximately 2500 to 6500 RPM, usually from about 3500 to 4500 RPM. The drive units also are commonly supplied with a threaded output shaft 20; usually a $\frac{5}{8}$ inch diameter shaft is provided.

Referring to FIG. 2, the lumber dressing tool of the present invention is shown in greater detail. This tool 22 has a generally circular configuration with a hub 24 that is dependent from one side thereof. The hub is provided with drive attachment means permitting its removable attachment to the rotary drive unit. In the illustrated and preferred embodiment, this comprises an internally threaded bore 26 in hub 24 with a diameter and threads matching the $\frac{5}{8}$ inch threaded shaft commonly found on most rotary drive units.

The tool 22 has a peripheral rim 28 projecting from the side of the disk 23 opposite the side which bears hub 24. The rim 28 has means for the removable attachment of a length of a band saw blade. As illustrated, the preferred attachment means comprises a circular groove 30 which is recessed in the face 32 of the peripheral rim 28. As shown in FIG. 2, a length of a band saw blade 34 is inset in the circular groove 30 at a depth which exposes only the teeth 36 of the band saw blade. This depth coincides with the depth of the gullet 38 of the band saw blade. Typically, band saw blades are provided with a width from about $\frac{3}{8}$ to $\frac{1}{2}$ inch and a gullet depth of approximately $\frac{1}{8}$ inch. The tool is provided with blade depth limiting stop means to ensure that the maximum exposure of the blade is from 0.1 to 0.3 inch, preferably 0.125 inch. Conveniently the blade depth limiting stop means comprises the depth of circular groove 30 in the peripheral rim 28 of the tool, thus permitting the blade to be quickly and precisely set at the proper depth by bottoming the blade in the circular groove 30. The blade is secured in the circular groove by a plurality of set screws 40 which are threadably inserted into radial, internally threaded bores 42 spaced about the periphery of the rim 28.

The peripheral rim 28 is secured to the hub by a web 44. This web can be solid as shown in FIG. 3. Alternatively, the web 44 could be formed with a plurality of spokes with open areas therebetween to reduce the overall weight of the tool. The solid web 44 is preferred, however, since this provides additional protection to the operator against flying chips.

The arrangement of the set screws 40 is also shown in FIG. 3. As there illustrated, a pair of set screws 40 are positioned, side-by-side at a location where the opposite ends 46 and 48 of the length of the band saw blade 34 meet. An additional pair of set screws 40 is provided exactly opposite the aforementioned pair to maintain balance of the tool 10. The remainder of the set screws 40 are then spaced about the peripheral rim 28 in equal angular spacings.

The tool of the invention is used for lumber dressing by moving it in overlapping passes across the surface of the lumber to be dressed to a saw-sized surface. In this method, the location of groove 30 in the peripheral rim 28 of the tool is important. The circular groove is inset a slight distance, typically from 0.15 to 0.4 inch from the outer edge of the peripheral rim 28. This permits the outer edge of the tool to be used as a guide to steady the tool against the workpiece. This is illustrated in FIG. 4 where a workpiece surface 50 is shown in working contact with the peripheral edge of the tool 22. As there illustrated, the band saw blade 34 is guided into contact with the surface 50 of the workpiece at an angle inclined thereto which is controlled by the distance 52 at which the blade is inset from the outer edge 54 of the tool 22. Preferably, this distance is $\frac{1}{4}$ inch for a tool having a depth of gullet 38 of $\frac{1}{8}$ inch between the adjacent teeth 36.

The tool permits rapid dressing of lumber to obtain a roughened surface which is indistinguishable from mill grade saw-sized surface. The tool is used in overlapping passes positioning the cutting surface of the tool at an angle as illustrated in FIG. 4. Surprisingly, the tool does not impart a circular pattern to the surface when it is moved across the surface of the workpiece in overlapping passes.

The tool can be used at the site of construction and can be used to roughen the entire surface of a timber or only exposed end surfaces, depending upon the application. Additionally, the tool can be used for rough size reduction and surfacing of floors and walls by removing of high spots, thus functioning in a manner similar to a rasp.

The tool can be maintained in a constantly sharp condition simply by replacing a used length of a band saw blade with a new length. The tool is also quite safe for use since the solid disk protects the operator and since the maximum cutting depth of the saw blade 34 is quite limited and, furthermore, is protected by the depth of inset 52 of the blade from the edge of the tool.

The invention has been described with reference to the illustrated and presently preferred embodiment. It is not intended that the invention be unduly limited by this disclosure of the presently preferred embodiment. Instead, it is intended that the invention be defined by the means, and their obvious equivalents, set forth in the following claims.

What is claimed is:

1. A lumber dressing tool comprising,
(a) a rigid circular disc;
(b) a hub dependent from one side of said disc;
(c) drive attachment means carried on said center hub permitting the removable attachment of said disc to a rotary drive unit;
(d) a single peripheral circular groove spaced from 0.1 to 0.5 inch inward of the periphery of said disc, and on the side of said disc opposite said hub, and having a sufficient depth to receive a length of a band saw blade and band saw blade lock means removably received in said disc to removably secure said blade; and
(e) blade depth limiting stop means in said groove permitting a maximum exposure of said saw blade from 0.1 to 0.3 inch.

2. The tool of claim 1 wherein said disc has a center web portion of reduced thickness interconnecting said hub and said peripheral rim.

3. The tool of claim 2 wherein said peripheral rim projects past the plane of said web, opposite said hub to provide a rim of greater thickness than said web portion.

4. The tool of claim 1 wherein said lock means comprises a plurality of set screws received in threaded bores extending from an edge of said rim and intersecting said groove and equally spaced about said disc to maintain balance of the tool.

5. The tool of claim 1 wherein said drive attachment means is an internally threaded arbor in said hub.

6. The tool of claim 3 wherein said groove has a depth from $\frac{1}{4}$ to $\frac{3}{8}$ inch and is inset about 0.25 inch from the peripheral edge of said rim.

* * * * *